United States Patent [19]

Nixon

[11] 4,307,318

[45] Dec. 22, 1981

[54] MINIATURE LAMP AND METHOD

[75] Inventor: Henry M. Nixon, Westfield, N.J.

[73] Assignee: Westinghouse Electric Corp., Pittsburgh, Pa.

[21] Appl. No.: 121,603

[22] Filed: Feb. 14, 1980

[51] Int. Cl.[3] ..... H01K 1/14

[52] U.S. Cl. ..... 313/315; 313/318; 29/25.1; 29/25.13

[58] Field of Search ..... 313/315, 318; 29/25.11, 29/25.1, 25.13

[56] References Cited

U.S. PATENT DOCUMENTS

| | | | |
|---|---|---|---|
| 3,668,391 | 6/1972 | Kimball | 313/315 |
| 4,028,577 | 6/1977 | Gates et al. | 313/315 |
| 4,122,367 | 10/1978 | Esklavon et al. | 313/318 |
| 4,144,473 | 3/1979 | Almer | 313/315 |
| 4,243,907 | 1/1981 | Kohl et al. | 313/315 |

*Primary Examiner*—Saxfield Chatmon, Jr.
*Attorney, Agent, or Firm*—R. S. Lombard

[57] ABSTRACT

A miniature lamp having a vitreous envelope with a generally tubular shaped bulb section and a press seal section with flattened parallel side portions. The bulb section encloses an elongated incandescent filament coil having a predetermined barrel length and a predetermined barrel radius. The filament coil has mounting leg members projecting from each end thereof and from opposite sides thereof. The lamp is so designed that the axis of the filament coil lies in a reference plane passing parallel to and intermediate the parallel planes defined by the flattened parallel side portions of the press seal section. Each of the mounting leg members proximate the top portion of the press seal section is offset a predetermined amount from the reference plane in a direction toward the side of the filament coil from which it projects with the angle which each mounting leg member is offset being such that the sine of the offset angle times the predetermined length of the projecting portion of the mounting leg member within the bulb section is approximately equal to the predetermined barrel radius of the filament coil. A method of making the miniature lamp is also disclosed.

2 Claims, 6 Drawing Figures

MINIATURE LAMP AND METHOD

BACKGROUND OF THE INVENTION

This invention relates to miniature lamps and, in particular, to a miniature lamp having a specialized mounting structure for the filament coil.

Miniature lamps such as the tungsten-halogen lamps used for automotive headlamps are well known in the art and for such applications it is critical that the filament coils be properly positioned within the lamp envelope so that the lamp functions properly with the accompanying lens and reflector assembly. It has been the practice to align the filament coil axis by bending the mounting leg members by hand. This procedure is expensive.

SUMMARY OF THE INVENTION

A miniature lamp comprising a vitreous envelope having a generally tubular shape bulb section and a press seal section with flattened parallel side portions. The bulb section encloses an elongated incandescent filament coil having a predetermined barrel length and a predetermined barrel radius. The filament coil has mounting leg members projecting from each end thereof and from opposite sides thereof. The press seal section has the end portions of the mounting leg members embedded therein. The portions of each of the mounting leg members that project within the bulb section to the press seal section have a predetermined length. Ribbon conductor members are affixed to the end portions of the mounting leg members and embedded in the press seal section. Mounting pin members are affixed to the end portions of the ribbon conductor members which are opposite to the filament coil and extend from the press seal section at the bottom of the lamp.

The axis of the filament coil lies in a reference plane passing parallel to and intermediate the parallel planes defined by the flattened parallel side portions of the press seal section. Each of the mounting leg members proximate the top portion of the press seal section is offset a predetermined amount from the reference plane in a direction towards the side of the filament coil from which it projects with the angle which each mounting leg member is offset being such that the sine of the offset angle times the predetermined length of the projecting portion of the mounting leg member within the bulb section is approximately equal to the predetermined barrel radius of the filament coil.

BRIEF DESCRIPTION OF THE DRAWINGS

For a better understanding of the invention, reference may be had to the accompanying drawings in which.

BRIEF DESCRIPTION OF THE PREFERRED EMBODIMENT

Figure 1:
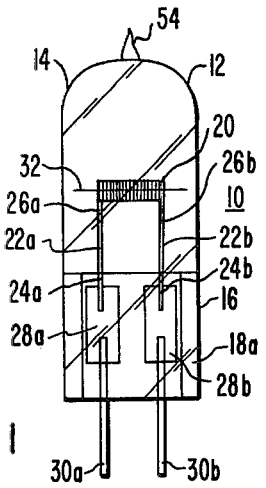
FIG. 1 is an elevational view, partly in section, of the miniature lamp of the present invention.
Figure 2:
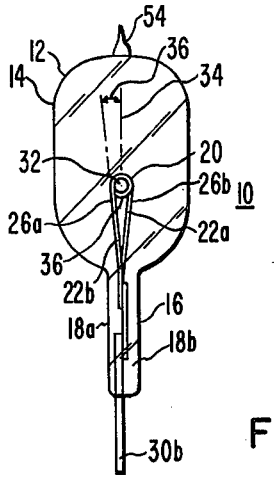
FIG. 2 is a side view of the lamp as shown in FIG. 1.

Referring to FIGS. 1 and 2, there is provided a miniature lamp 10 comprising a vitreous envelope 12 having a generally tubular-shaped bulb section 14 and a press seal section 16 with flattened parallel side portions 18*a*, 18*b*. The bulb section 14 encloses an elongated incandescent filament coil having a predetermined barrel length such as 0.200 in. (0.508 cm.) and a predetermined barrel radius such as 0.025 in. (0.0635 cm.). The filament coil 20 has mounting leg members 22*a*, 22*b* projecting from each end thereof and from opposite sides thereof. The lamp may be of the tungsten-halogen type where the quartz bulb section 14 encloses a filling of krypton at a predetermined partial pressure of 2.5 atmospheres and a small charge of methylene bromide, and the filament coil 20 is made of tungsten wire. The pressed seal section 16 has the end portions 24*a*, 24*b* of the mounting leg members 22*a*, 22*b* embedded therein. The portion 26*a*, 26*b* of each of the mounting leg members that projects within the bulb section to the press seal section 16 has a predetermined length such as 0.394 in. (1.0 cm.). Ribbon conductors 28*a*, 28*b* are affixed to the end portions of the mounting leg members 22*a*, 22*b* as shown in FIG. 1. Mounting pin members 30*a*, 30*b* are affixed to the end portions of the ribbon conductor members 28*a*, 28*b* which are opposite to the filament coil 20 and extend from the pressed seal section 16 at the bottom of the lamp 10.

The axis 32 of the filament coil 20 lies in a reference plane 34 parallel to and intermediate the parallel planes defined by the parallel side portions 18*a*, 18*b* of the press seal section 16. Each of the mounting leg members 22*a*, 22*b* proximate the top portion of the pressed seal section 16 is offset from the reference plane 34 in a direction toward the side of the filament coil 20 from which it projects, as shown in FIG. 2, with the angle 36 which each mounting leg member 22*a*, 22*b* is offset being such that the sine of the offset angle times the predetermined length of the projecting portion 26*a*, 26*b* of the mounting leg member 22*a*, 22*b* within the bulb section 14 is approximately equal to the predetermined barrel radius of the filament coil. In the lamp shown in FIG. 1, the portion 26*a* of mounting leg member 22*a* in the bulb section 14 has a length such as 0.394 in. (1.0 cm.) and an offset angle 36 such as 3°38′. Therefore, the sine of the offset angle 36 equals 0.06337 and this times the 0.394 in. length of the projecting portion 26*a* is approximately equal to the predetermined barrel radius of 0.025 in. of the filament coil 20.

Figure 3:
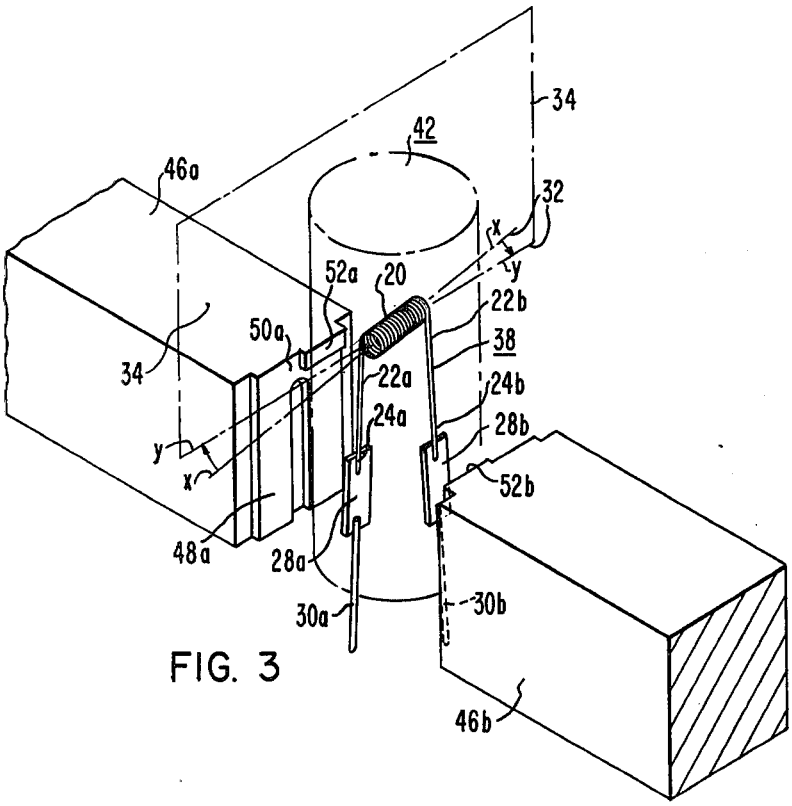
FIG. 3 is an isometric view of the filament coil and ribbon conductor member assembly and vitreous tubular member positioned between the matrix pressing jaws before the flattening of the tubular member.
Figure 4:
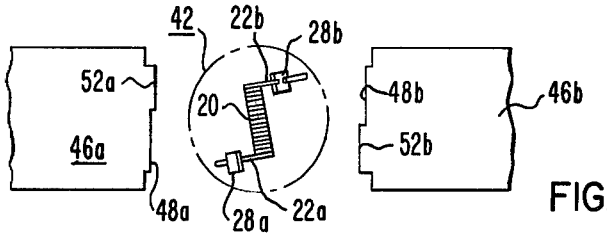
FIG. 4 is a top view of FIG. 3.
Figure 5:
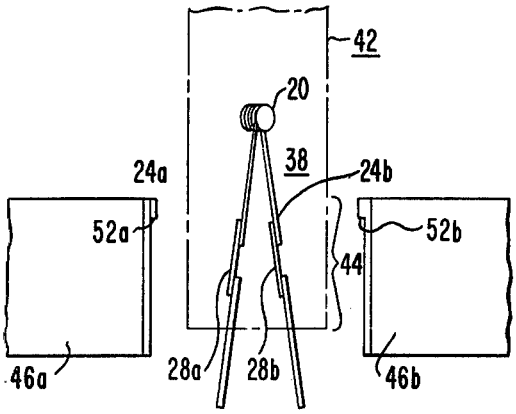
FIG. 5 is an elevational view of FIG. 3.
Figure 6:
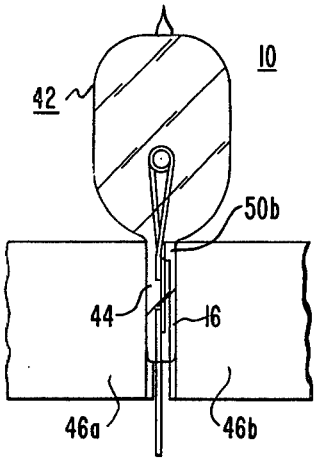
FIG. 6 is an elevational view showing the completed miniature lamp of the present invention held within the matrix pressing jaws.

Referring to FIGS. 3–5, where corresponding numerals represent corresponding parts in FIGS. 1 and 2, there is shown the method of mounting the filament coil 20 within the miniature lamp 10. The method comprises forming a filament coil and ribbon conductor member assembly 38 by affixing to the end portions 24*a*, 24*b* of the mounting leg members 22*a*, 22*b*, the ribbon conductor members 28*a*, 28*b* and affixing the mounting pin members 30*a*, 30*b* to the end portions of the ribbon conductor members 28*a*, 28*b* which are opposite to the filament coil 20. A predetermined portion 44 of the vitreous tubular member 42 which is to constitute the pressed seal section 16 of the lamp 10 is heated to the softening point which in the case of quartz glass is about 1580° C. A softened portion 44 of the vitreous tubular member 42 is then flattened with a pair of matrix pressing jaws 46*a*, 46*b*. The matrix pressing jaws 46*a*, 46*b* have generally flattened parallel jaw portions 48*a*, 48*b* conforming to the configuration desired for the press seal section 16. The parallel jaw portions 48*a*, 48*b* each have at the upper pressing portion 50*a*, 50*b* thereof small projecting members 52*a*, 52*b* which are positioned at either side of the parallel jaw portions 48*a*, 48*b* as shown in FIGS. 3 and 4. The projecting members 52*a*, 52*b* are aligned to contact the softened portion 44 of the vitreous tubular member 42 which is to constitute the pressed seal section 16 of the lamp 10 opposite the end portions 24*a*, 24*b* of the leg members 22*a*, 22*b*.

The projecting members 52*a*, 52*b* project from the generally flattened surface of the parallel jaw portions 48*a*, 48*b* a predetermined distance such that upon the softened portion 44 of the vitreous tubular member being flattened by the pressing jaws 46*a*, 46*b*, each of the end portions of the filament coil 20 are caused to move in opposite directions a distance equal to the barrel radius of the filament coil 20, thereby causing the filament coil axis 32 to lie in the reference plane 34. In FIG. 3, the arrows between points X and Y indicate the direction and distance that each end portion of the filament coil moves, and for the lamp 10, shown in FIGS. 1 and 2, this distance is equal to 0.025 in., the barrel radius. For this lamp, the projecting members 52*a*, 52*b* project from the generally flattened surface of the parallel jaw portions 48*a*, 48*b* 0.00787 in. (0.2 mm.). Immediately upon pressing, the vitreous press "hardens" to retain the offset orientation of the mounting leg members 22*a*, 22*b*.

In the preferred form, mounting pin members 30*a* and 30*b* are provided and fit into a receiving socket member. These pin members can be replaced by any conventional type electrical connection means, such as a flattened base which provides the proper orientation for the filament. After the pressing operation, the lamp fabrication is completed by baking, dosing and completing the top tip-off 54, see FIGS. 1 and 2, in accordance with conventional practices.

I claim:

1. A miniature lamp comprising a vitreous envelope having a generally tubular-shaped bulb section and a pressed seal section with flattened parallel side portions, said bulb section enclosing an elongated incandescent filament coil having a predetermined barrel length and a predetermined barrel radius, said filament coil having mounting leg members projecting from each end thereof and from opposite sides thereof, said pressed seal section having the end portions of said mounting leg members embedded therein, the portion of each of said mounting leg members that projects within said bulb section from said pressed seal section having a predetermined length, ribbon conductor members affixed to said end portions of said mounting leg members and embedded in said pressed seal section, mounting electrical connection means affixed to the end portions of said ribbon conductor members which are opposite to said filament coil and extending from said pressed seal section at the bottom of said lamp, the axis of said filament coil lying in a reference plane passing parallel to and intermediate the parallel planes defined by said flattened parallel side portions of said pressed seal section, each of said mounting leg members proximate the top portion of said press seal section is offset from said reference plane in a direction toward the side of said filament coil from which it projects with the angle which each mounting leg member is offset being such that the sine of the offset angle times the predetermined length of said projecting portion of said mounting leg member within said bulb section is approximately equal to said predetermined barrel radius of said filament coil.

2. A method of mounting an elongated incandescent filament coil having a predetermined barrel length and a predetermined barrel radius within a miniature lamp having a vitreous envelope, said vitreous envelope having a generally tubular shaped bulb section and a press seal section with flattened parallel side portions so that the axis of said filament coil lies in a reference plane passing parallel to and intermediate the parallel plane defined by said flattened parallel side portions of said press seal section, said filament coil having mounting leg members projecting from each end thereof and from opposite sides thereof, which method comprises:

(a) forming a filament coil and ribbon conductor member assembly by affixing to the end portions of said mounting leg members ribbon conductor members, and affixing mounting pin members to the end portions of said ribbon conductor members which are opposite to said filament coil;

(b) placing a predetermined portion of said filament coil and ribbon conductor member assembly into a vitreous tubular member which is to comprise said vitreous envelope;

(c) heating to the softening point that portion of said vitreous tubular member which is to constitute said pressed seal section;

(d) flattening said softened portion of said vitreous tubular member with a pair of matrix pressing jaws, said matrix pressing jaws having generally flattened parallel jaw portions conforming to the configuration desired for said pressed seal section, said parallel jaw portions each having at the upper pressing portion thereof small projecting members which are positioned at either side of said parallel jaw portions and aligned to contact said softened portion of said vitreous tubular member which is to constitute said press seal section opposite the end portions of said leg members, said projecting members projecting from the generally flattened surface of said parallel jaw portions a predetermined distance such that upon said softened portion of said vitreous tubular member being flattened by said pressing jaws each of the end portions of said filament coil are caused to move in opposite directions a distance approximately equal to the barrel radius of said filament coil thereby causing said filament coil axis to lie in said reference plane.

* * * * *